US007595916B2

(12) United States Patent
Morimoto et al.

(10) Patent No.: US 7,595,916 B2
(45) Date of Patent: Sep. 29, 2009

(54) MANUSCRIPT CARRYING APPARATUS AND AUTOMATIC MANUSCRIPT READING APPARATUS USING SAME

(75) Inventors: Yasumasa Morimoto, Nara (JP); Masato Tamehira, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 975 days.

(21) Appl. No.: 11/057,251

(22) Filed: Feb. 15, 2005

(65) Prior Publication Data

US 2005/0184449 A1 Aug. 25, 2005

(30) Foreign Application Priority Data

Feb. 20, 2004 (JP) ..... 2004-044850

(51) Int. Cl.
*H04N 1/04* (2006.01)

(52) U.S. Cl. ..... 358/474; 358/496; 358/498; 271/118; 271/121; 271/117; 399/370; 399/376; 399/386

(58) Field of Classification Search ..... 358/498, 358/474, 496, 497; 271/117, 118, 10.11, 271/113, 121, 114, 116, 9.06; 399/370, 386, 399/376, 389

See application file for complete search history.

(56) References Cited

U.S. PATENT DOCUMENTS 4,702,889 A * 10/1987 Cabrera et al. ..... 422/103
5,043,770 A * 8/1991 Nagano et al. ..... 399/392
5,887,867 A * 3/1999 Takahashi et al. ..... 271/117
6,009,302 A * 12/1999 Worley et al. ..... 399/367
6,022,012 A * 2/2000 Worley ..... 271/3.14
6,158,731 A * 12/2000 Nakagawa ..... 271/11
6,167,232 A * 12/2000 Jimenez et al. ..... 399/367
6,322,065 B1 * 11/2001 Underwood et al. ..... 271/117
6,866,259 B2 * 3/2005 Underwood et al. ..... 271/117
6,877,734 B2 * 4/2005 Muratani ..... 271/97
7,125,013 B2 * 10/2006 Sonoda et al. ..... 271/121
7,380,783 B2 * 6/2008 Klein ..... 271/117
2002/0033572 A1 * 3/2002 Takisawa et al. ..... 271/109
2009/0014944 A1 * 1/2009 Kobayashi ..... 271/118

FOREIGN PATENT DOCUMENTS

JP 08-295427 11/1996
JP 2001-002256 1/2001
JP 2001-220026 8/2001

* cited by examiner

*Primary Examiner*—Houshang Safaipour
*Assistant Examiner*—Negussie Worku
(74) *Attorney, Agent, or Firm*—Nixon & Vanderhye P.C.

(57) ABSTRACT

In an embodiment of the present invention, a pickup roller R1 makes soft contact to an upper surface of a manuscript by being lowered incrementally in four raising-lowering operations S1 to S4 in which, when an electromagnetic clutch connects, the pickup roller is lowered, while being rotated, to approach the upper surface of the top manuscript and, when the electromagnetic clutch disconnects, the pickup roller, while stopping to rotate, is raised away from the upper surface of the top manuscript by an amount smaller than a lowering amount. Between an electromagnetic clutch-side engaging portion and a pickup roller-side engaging portion of a torque limiter, an elastic member is arranged that suppresses drive power load fluctuation produced by disconnection/connection of the electromagnetic clutch and applies a biasing force in a direction to raise the pickup roller when the electromagnetic clutch disconnects.

11 Claims, 11 Drawing Sheets

MANUSCRIPT CARRYING APPARATUS AND AUTOMATIC MANUSCRIPT READING APPARATUS USING SAME

CROSS REFERENCE TO RELATED APPLICATIONS

This application claims priority under 35 U.S.C. § 119(a) to Patent Application No. 2004-44850 filed in Japan on Feb. 20, 2004, the entire contents of which are hereby incorporated by reference.

BACKGROUND

1. Field

The disclosure relates to manuscript carrying apparatuses that take out sheet-by-sheet and successively carry one or more sheet-shaped manuscripts loaded in a layered state, to perform image reading.

2. Background

Conventionally two techniques, a fixed manuscript technique and a moving manuscript technique, are known for reading manuscript images.

In the fixed manuscript technique, the manuscript is fixed and an image information reading portion (optical unit) scans and reads it, which is therefore suitable for book-form manuscripts and thick-sheeted manuscripts. Furthermore, since the image information reading portion (optical unit) does the scanning, there is the advantage that reading precision is easy to increase.

In contrast to this, with the moving manuscript technique, the image information reading portion (optical unit) is fixed and reading is achieved by letting the manuscript do the scanning movement, and therefore there are the advantages that apparatus compactness can be achieved and the area occupied by an image forming apparatus or the like can be reduced. Furthermore, by placing manuscripts together in a manuscript tray, the manuscripts can be automatically taken out sheet by sheet and read, and therefore there are the large advantages that time and effort are reduced for a user and that a large amount of manuscripts can be read in a short time.

While the number of manuscripts that could be placed at one time in the manuscript tray with the moving manuscript technique was previously around 20 to 40 sheets, in recent years this has become around 100 sheets. Improved printing speeds, increased capacity of the memories in control portions that are provided in reading apparatuses and in which image data are temporarily stored, and improved control portion processing speeds have contributed to this.

However, when the number of sheets of manuscripts loaded in this way increases, there is a decreasing probability that the manuscripts (one job), once loaded, will be carried and read without any trouble. Furthermore, when the manuscript reading apparatus is used as a copying device incorporated into an image forming apparatus, the manuscript reading apparatus must also stop whenever there is trouble on the image forming apparatus side. And when this causes a manuscript to get caught up in the manuscript carry path, it is necessary to remove that manuscript.

On the other hand, there are apparatuses (see JP 2001-2256A for example) provided with a pickup roller that moves down from above one or more manuscripts loaded in the manuscript tray, then, upon contact, automatically takes out by its own rotation the top manuscript sheet by sheet and carries the manuscript in the carry path.

In this regard, the above-mentioned pickup roller is not always in contact with the top manuscript loaded in the manuscript tray, but is configured so as to come down and contact the top manuscript each time a manuscript is to be carried to the carry path. In this case, since the loaded amount of manuscripts loaded in the manuscript tray is not decided, there is a considerable difference in the distance by which the pickup roller comes down until it contacts the upper surface of the top manuscript loaded in the manuscript tray between when a small amount of manuscripts are loaded and when a large amount of manuscripts are loaded. For this reason, depending on differences in the descent velocity due to the driving force from the drive source when causing the pickup roller to descend and the pickup roller's own weight, the fewer manuscripts loaded in the manuscript tray, the larger the impact sound (contact sound) produced when contact is made with the upper surface of the manuscripts (i.e. the upper surface of the top manuscript among the manuscripts).

Furthermore, when a plurality of manuscripts are loaded in the manuscript tray, a clutch is provided to disconnect the pickup roller from the driving force of the drive source in order to intermittently carry the manuscripts by the rotation of the pickup roller in contact with the upper surface of the top manuscript, but this clutch disconnection-connection operation carried out between manuscripts causes drive power load fluctuation of the driving drive source. For this reason, a slight lag in the carry speed of the manuscript carried to the manuscript reading portion that reads manuscripts tends to be caused by the drive power load fluctuation, thus producing blurring in the reading of the manuscript in the manuscript reading portion.

SUMMARY

One or more embodiments of the present invention have been devised in consideration of these issues, and it is an object thereof to provide a manuscript carrying apparatus that is capable of reducing the impact sound as much as possible when the pickup roller is lowered and brought in contact with the upper surface of the top manuscript loaded in the manuscript tray and capable of reliably preventing blurring of the reading of the manuscripts in the manuscript reading portion that originates in drive power load fluctuation due to disconnection/connection actions of the clutch, as well as an automatic manuscript reading apparatus using this.

An embodiment of a manuscript carrying apparatus automatically takes out sheet-by-sheet and carries to a carry path one or more manuscripts loaded in a manuscript tray, through contact with a pickup roller that rotates while being lowered from above the manuscripts, wherein the pickup roller is disconnectably connected to a drive source via a clutch and is configured to make soft contact to an upper surface of the top manuscript in the manuscript tray by being lowered incrementally and gradually in a plurality of repetitions of a raising-lowering operation in which, when the clutch connects, the pickup roller is lowered, while being rotated, to approach the upper surface of the top manuscript in the manuscript tray and, when the clutch disconnects, the pickup roller, while stopping to rotate, is raised away from the upper surface of the top manuscript in the manuscript tray by an amount smaller than a lowering amount due to a biasing force of a biasing force portion that applies an upward biasing force, wherein at least one driving force transmission member that transmits a driving force to the pickup roller by an engagement of mutually partitioned engaging portions when the clutch connects is provided between the clutch and the pickup roller, and wherein at least one elastic member that suppresses drive power load fluctuation produced by disconnection/connection of the clutch is provided between the clutch-side engaging portion partitioned in the pickup roller and the pickup roller-side engaging portion partitioned in the clutch side of the driving force transmission member.

Also, another embodiment of a manuscript carrying apparatus automatically takes out sheet-by-sheet and carries to a carry path one or more manuscripts loaded in a manuscript tray, through contact with a pickup roller that rotates while being lowered from above the manuscripts, wherein the pickup roller is disconnectably connected to a drive source via a clutch and is configured to make soft contact to an upper surface of the top manuscript in the manuscript tray by being lowered incrementally and gradually in a plurality of repetitions of a raising-lowering operation in which, when the clutch connects, the pickup roller is towered, while being rotated, to approach the upper surface of the top manuscript in the manuscript tray and, when the clutch disconnects, the pickup roller, white stopping to rotate, is raised away from the upper surface of the top manuscript in the manuscript tray by an amount smaller than a towering amount, wherein at least one driving force transmission member that transmits a driving force to the pickup roller by an engagement of mutually partitioned engaging portions when the clutch connects is provided between the clutch and the pickup roller, and wherein at least one elastic member that suppresses drive power load fluctuation produced by disconnection/connection of the clutch and applies a biasing force in a direction causing the pickup roller to rise when the clutch disconnects is provided between the clutch-side engaging portion partitioned in the pickup roller and the pickup roller-side engaging portion partitioned in the clutch side of the driving force transmission member.

With such a manuscript carrying apparatus, the pickup roller is incrementally and gradually lowered repetitively a plurality of times by the disconnection and connection of the clutch in raising-lowering operations in which the pickup roller is lowered to approach a lowermost position of non-contact to the upper surface of the top manuscript in the manuscript tray and is raised away from the surface by an amount smaller than the lowering amount thereof, and makes soft contact with the upper surface of the top manuscript in the manuscript tray. In this way, the pickup roller always makes soft contact with the upper surface of the top manuscript in the manuscript tray even when there is a considerable difference in the distance the pickup roller descends until making contact with the upper surface of the top manuscript loaded in the manuscript tray between when a small amount of manuscripts is loaded and when a large amount of manuscripts is loaded, and even when for instance there are few manuscripts loaded in the manuscript tray, the impact sound (contact sound) produced by the contact with the upper surface of the top manuscript can be made as small as possible.

In addition to this, since drive power load fluctuation produced when the clutch connects is suppressed by the elastic member between the clutch-side engaging portion and the pickup roller-side engaging portion of the driving force transmission member, when a plurality of manuscripts are carried intermittently by the rotation of the pickup roller contacting the upper surfaces of the manuscripts, the impact caused by the engagement action of the clutch-side engaging portion and the pickup roller-side engaging portion of the driving force transmission member when a connection action of the clutch is carried out between manuscripts is eased by the elastic member and does not almost become a cause of drive power load fluctuation when the clutch connects. In this way, there is almost no slight lag in the carry velocity of the manuscripts being carried to the manuscript reading portion and blurring in the reading of the manuscript caused by drive current load fluctuation in the manuscript reading portion can be reliably prevented.

Moreover, when the pickup roller is caused to rise at the time the clutch disconnects using the elastic member, which eases the impact of the engagement action of the clutch-side engaging portion and the pickup roller-side engaging portion of the driving force transmission member, it is possible to reduce the number of components by making a component have a double purpose.

Furthermore, with one or more embodiments of the manuscript carrying apparatuses, it is also possible that a first raising-lowering operation of the plurality of incremental raising-lowering operations of the pickup roller is carried out such that the pickup roller is lowered to approach a lowermost position of non-contact to the upper surface of manuscripts when a maximum loadable amount of manuscripts is loaded in the manuscript tray and is raised away from the upper surface of the top manuscript by an amount less than that lowering amount.

With such a manuscript carrying apparatus, the pickup roller does not make contact with the upper surface of the top manuscript in the first raising-lowering operation even when the maximum loadable amount of the manuscripts are loaded in the manuscript tray, and it is possible to efficiently and rapidly bring about contact of the pickup roller to the upper surface of the top manuscript by carrying out a plurality of raising-lowering operations with the first lowering amount of the pickup roller being made as large as possible.

Furthermore, in the embodiment(s) of the manuscript carrying apparatuses, it is also possible that the plurality of incremental raising-lowering operations of the pickup roller is preset to a predetermined number of times such that the pickup roller makes contact with the upper surface of the top manuscript in the manuscript tray, and the pickup roller is configured to continuously rotate once the predetermined number of times of the raising-lowering operations have been accomplished so as to carry the top manuscript to the carry path.

With such a manuscript carrying apparatus, it is possible to make the pickup roller reliably contact the top manuscript when the predetermined number of times of raising-lowering operations have been accomplished. In addition to this, even if the pickup roller makes contact with the top manuscript before accomplishing the predetermined number of times of raising-lowering operations, the top manuscript is intermittently carried to the carry path by the rotation accompanying the lowering of the pickup roller such that the driving force of the pickup roller can be transmitted almost without waste to the top manuscript.

Furthermore, it is also possible that a manuscript carrying apparatus according to some example embodiment(s) is provided with a separator portion further downstream from the pickup roller in the carry path, the separator portion separating only the top manuscript from a plurality of manuscripts inadvertently carried by the pickup roller, wherein the total carry distance of the top manuscript carried intermittently by rotation accompanying lowering in the predetermined number of times of raising-lowering operations of the pickup roller is set shorter than a manuscript carry distance from a carry-direction leading edge of the top manuscript when the manuscripts are loaded to the maximum loadable amount in the manuscript tray until the separator portion.

With such a manuscript carrying apparatus, when the pickup roller makes contact with the top manuscript before accomplishing the predetermined number of times of raising-lowering operations, even if the top manuscript is intermittently carried to the carry path by the rotation accompanying the lowering of the pickup roller, the carry-direction leading edge of the top manuscript does not reach the separator portion. For this reason, even when the top manuscript and the manuscript under it are inadvertently carried together when the top manuscript is intermittently carried by the rotation accompanying the lowering of the pickup roller, the carry-direction leading edges of the plurality of manuscripts do not reach the separator portion, and the plurality of manuscripts carried by the continuous rotation of the pickup roller after the accomplishment of the predetermined number of times of raising-lowering operations are reliably separated by the separator portion and it is possible to reliably prevent double-feeding of a plurality of manuscripts to the carry-direction downstream side from the separator portion.

Furthermore, it is possible that a manuscript carrying apparatus according to some example embodiment(s) is provided with at least one leading-trailing edge detection sensor at a mid-position of the carry path that detects a carry-direction leading/trailing edge of the manuscript, wherein the total carry distance of the top manuscript carried intermittently by rotation accompanying lowering in the predetermined number of times of raising-lowering operations of the pickup roller is set to a manuscript carry distance in which at least the carry-direction leading edge does not reach the leading-trailing edge detection sensor.

With such a manuscript carrying apparatus, when the pickup roller makes contact with the top manuscript before accomplishing the predetermined number of times of raising-lowering operations, even if the top manuscript is intermittently carried to the carry path by the rotation accompanying the lowering of the pickup roller, the carry-direction leading edge of the top manuscript does not reach the leading-trailing edge detection sensor. For this reason, manuscripts carried intermittently by the rotation accompanying the lowering of the pickup roller are not detected by the leading-trailing edge detection sensor that detects manuscripts carried by continuous rotation of the pickup roller after the predetermined number of times of raising-lowering operations are accomplished and, it is possible to prevent adverse effects to the PS rollers, which set the timing for manuscript reading based on a detected detection signal from the leading-trailing edge detection sensor, and carry out manuscript reading smoothly without causing a delay.

Furthermore, with a manuscript carrying apparatus according to some example embodiment(s), it is possible that the plurality of incremental raising-lowering operations of the pickup roller is preset to a predetermined number of times such that the pickup roller makes contact with the upper surface of the top manuscript in the manuscript tray, wherein contact of the pickup roller to the upper surface of the top manuscript in the manuscript tray is detected based on drive power load fluctuation produced when the pickup roller makes contact with the upper surface of the top manuscript, and the pickup roller is configured such that, based on drive power load fluctuation detected when contact is made with the upper surface of the top manuscript in the manuscript tray before the predetermined number of times of raising-lowering operations are accomplished, subsequent raising-lowering operations are stopped and the pickup roller continuously rotates so as to carry the top manuscript to the carry path.

With such a manuscript carrying apparatus, when the pickup roller makes contact with the upper surface of the top manuscript in the manuscript tray before the preset predetermined number of times of raising-lowering operations have been accomplished, subsequent raising-lowering operations are stopped and the top manuscript is carried to the carry path by the continuous rotation of the pickup roller, and therefore the top manuscript is swiftly carried to the carry path and reading of the manuscript can be carried out speedily.

Furthermore, an automatic manuscript reading apparatus according to some example embodiment(s) is characterized by using any of the above-described manuscript carrying apparatuses.

Such an automatic manuscript reading apparatus can reduce the impact sound (contact sound) as much as possible when the pickup roller is brought in contact with the upper surface of the top manuscript regardless of the amount of manuscripts loaded in the manuscript tray and ease the impact at the time of an engagement action between the drive source-side engaging portion and the pickup roller-side engaging portion. In this way, it is possible to provide an automatic manuscript reading apparatus that enables reductions in the number of components while reliably preventing blurring of the reading of the manuscripts due to drive power load fluctuation in the manuscript reading portion.

DESCRIPTION OF PREFERRED EMBODIMENTS

Hereinafter, example embodiments for executing the present invention will be described with reference to the accompanying drawings.

Figure 1:
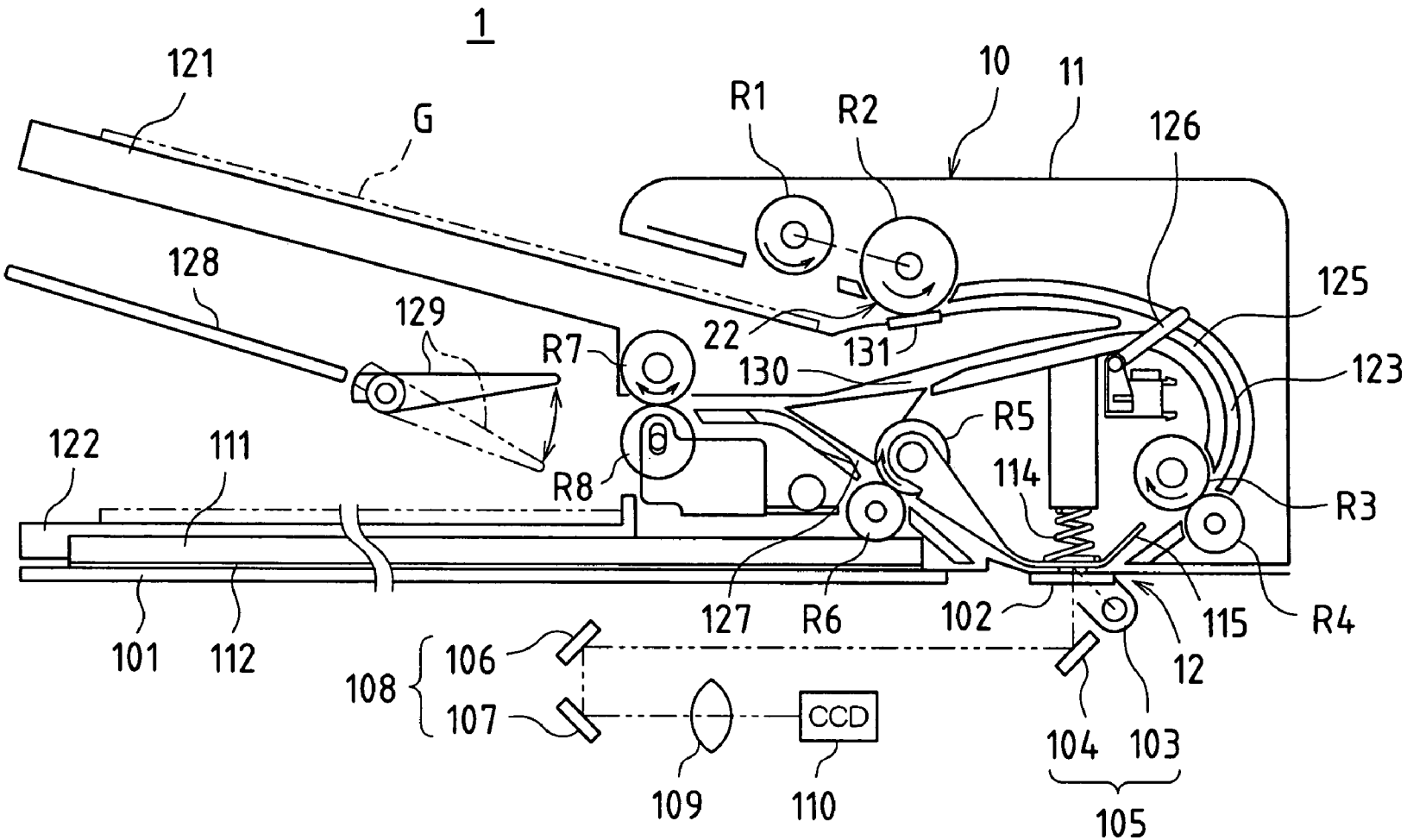
FIG. 1 is a longitudinal sectional view of a manuscript reading apparatus provided with a manuscript carrying apparatus associated with an example embodiment.

FIG. 1 is a longitudinal sectional view of an automatic manuscript reading apparatus 1 provided with a manuscript carrying apparatus 10 associated with an embodiment of the present invention.

The automatic manuscript reading apparatus 1 is provided with a first manuscript rest 101 and a second manuscript rest 102 at a lower side of the manuscript carrying apparatus 10, and is capable of reading a manuscript G that is placed in a stationary state on the first manuscript rest 101 and is also capable of reading a manuscript G while the manuscript G is being carried over the second manuscript rest 102. In order to achieve such reading, arranged underneath the first manuscript rest 101 and the second manuscript rest 102 are a light source unit 105 constituted by a light source 103 and a mirror 104, a mirror unit 108 constituted by mirrors 106 and 107, an imaging lens 109, and a CCD reading unit 110.

When performing stationary reading using the first manuscript rest 101, the optical path length to the CCD reading unit is kept constant and an image of the entire surface of the manuscript G is read by having the light source unit 105 perform a scanning movement below the first manuscript rest 101 at a constant velocity V and the mirror unit 108 perform a scanning movement at half that velocity V/2. And when performing moving reading using the second manuscript rest 102, an image of the entire surface of the manuscript G is read by making the light source unit 105 come to a standstill below the second manuscript rest 102 and carrying the manuscript G in a way that will be described below. Furthermore, a manuscript presser 112 is arranged in opposition to the first manuscript rest 101 on the underside of a manuscript cover 111 and a manuscript presser 115 is arranged in opposition to the second manuscript rest 102. The manuscript presser 115 applies a biasing force on the second manuscript rest 102 with a biasing spring 114.

Broadly speaking, the sheet carrying mechanism in the automatic manuscript reading apparatus 1 is constituted by a manuscript tray 121 arranged relatively upward, a manuscript discharge tray 122 arranged below the manuscript tray 121, and a curved carry path 123 that connects these.

The manuscripts G loaded in the manuscript tray 121 are taken out by a pickup roller R1, which will be described below, then separated sheet by sheet by a separator roller R2 and a separator plate 131 that will be described below, and carried to a main carry path 125 formed by the curved carry path 123. After the carrying of the manuscript G has been confirmed by a manuscript insertion sensor 126 that acts as a leading-trailing edge detection sensor, the carried manuscript G is carried to a manuscript reading portion 12 of the second manuscript rest 102 via a drive roller R3 that acts as a timing roller (PS roller) that aligns an oblique leading edge of the manuscript G and dispatches the manuscript with a specified image reading timing and a following roller R4 that forms a pair with this, such that an image of the manuscript G undergoes reading.

Once the reading of a manuscript G by the manuscript reading portion 12 of the second manuscript rest 102 has been completed, the manuscript G is withdrawn from the manuscript reading portion 12 by a pair of carry rollers R5 and R6, and discharged by way of a discharge path 127 to the manuscript discharge tray 122 by a pair of discharge rollers R7 and R8 that are capable of reverse rotation.

Furthermore, in the automatic manuscript reading apparatus 1, an intermediate tray 128 is arranged between the manuscript tray 121 and the manuscript discharge tray 122, and a swinging plate 129 is arranged facing the discharge rollers R7 and R8. As shown by the solid line in FIG. 1, when the swinging plate 129 is raised upward (home position 1), the manuscript G discharged by the discharge rollers R7 and R8 is discharged to the manuscript discharge tray 122. As shown by the imaginary line (dot-dot-dashed line) in FIG. 1, when the swinging plate 129 inclines downward (home position 2), the manuscript G discharged by the discharge rollers R7 and R8 is scooped up the swinging plate 129 and discharged to the intermediate tray 128.

The intermediate tray 128 and the swinging plate 129 are provided to enable the reading of the front and reverse sides of the manuscript G, and a manuscript G carried in the discharge path 127 and discharged by the discharge rollers R7 and R8 is discharged to the intermediate tray 128, then held still sandwiched by its trailing edge between the discharge rollers R7 and R8. After this, the manuscript G enters a secondary carry path 130 by being reversed by the discharge rollers R7 and R8, then converged to the curved carry path 123 from the secondary carry path 130. In this way, an image of the upper surface of the top manuscript G loaded in the manuscript tray 121 is first read, then an image of the rear surface of the manuscript G is read by doing a switchback carry via the discharge path 127, the discharge rollers R7 and R8, the swinging plate 129, the intermediate tray 128 and the secondary carry path 130.

Figure 2:
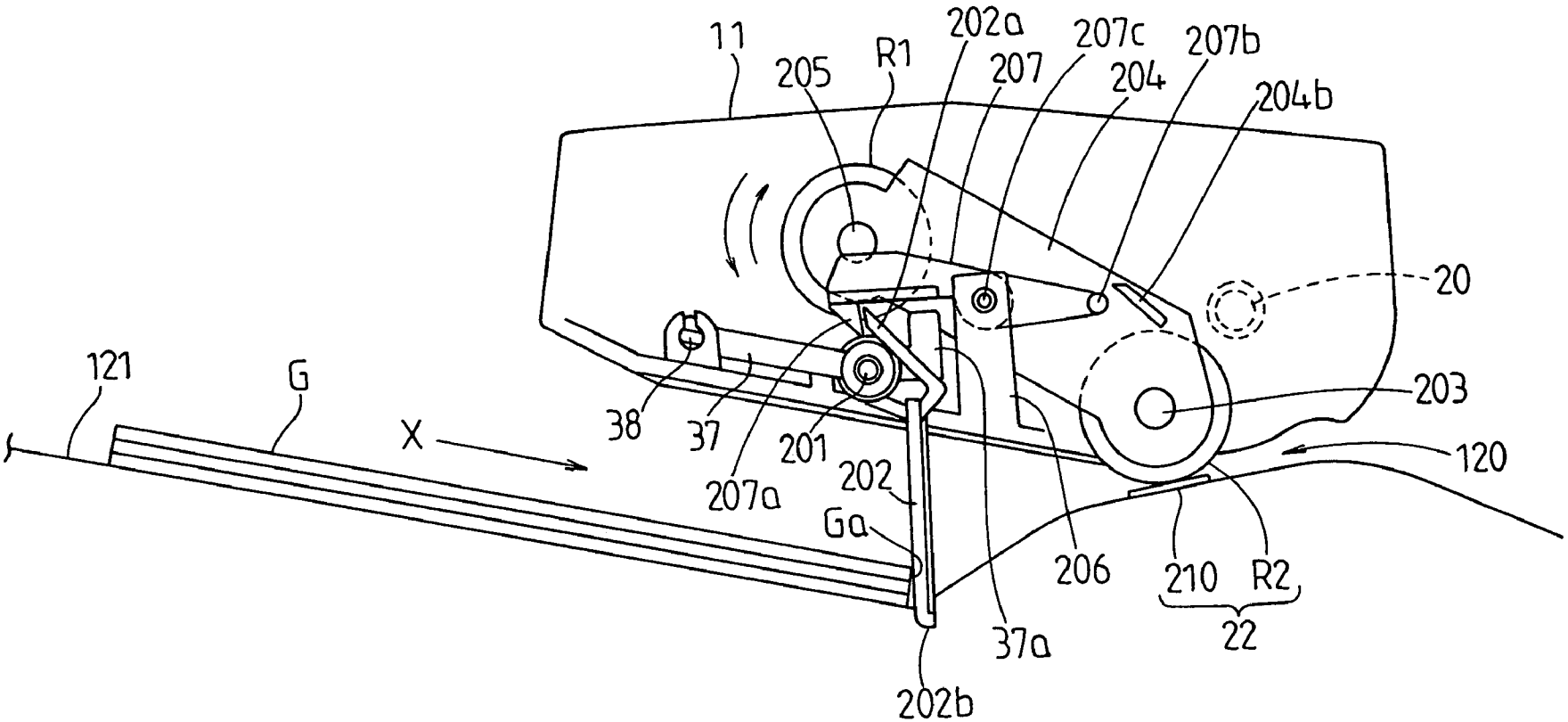
FIG. 2 is a longitudinal sectional view showing an overall configuration of the manuscript carrying apparatus.
Figure 3:
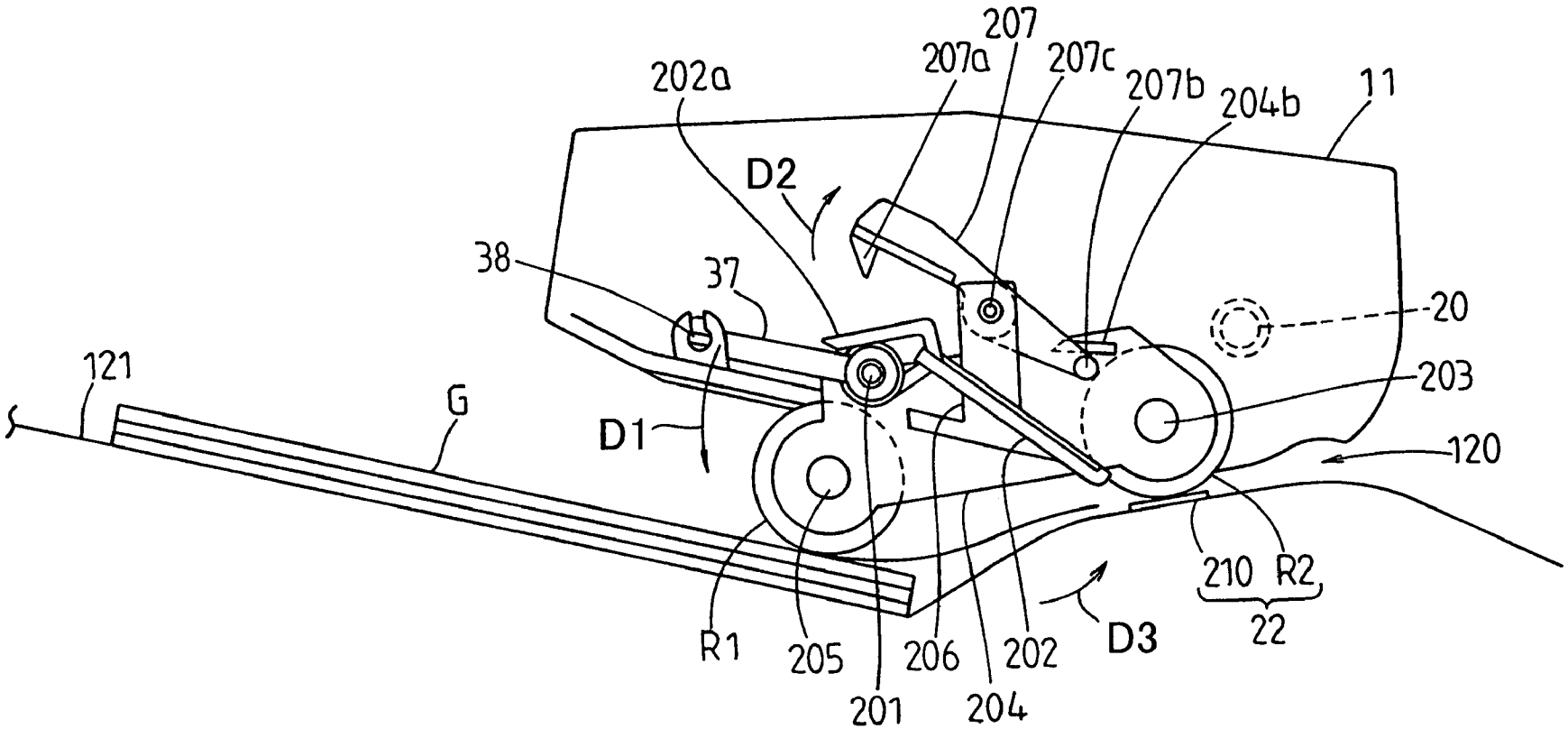
FIG. 3 is a longitudinal sectional view showing an overall configuration of the manuscript carrying apparatus.

FIGS. 2 and 3 are longitudinal sectional views showing overall configurations of the manuscript carrying apparatus 10, and in FIGS. 2 and 3, the pickup roller R1 and the separator roller R2 are accommodated in an outer covering 11 of the manuscript carrying apparatus 10. The outer covering 11 is supported so as to be freely openable and closable such that its free end (the left side in FIGS. 2 and 3) can be moved upwards centered on a support axle 20 arranged in a direction orthogonal to a carry direction X of the manuscript G. Furthermore, at the free end of the outer covering 11, a stopper member 202 is supported by a supporting axis 201 arranged in a direction orthogonal to the carry direction X such that the stopper member 202 is capable of a swinging movement.

The separator roller R2, which is integrally connected to and rotates with a support pin 203 that extends in a direction orthogonal to the carry direction X, is arranged at the carry path 120 upstream from the pickup roller R1, that is, at an edge of the base end of the outer covering 11, and another end (the left side in FIGS. 1 and 2) of a pull-in arm 204 is supported so as to readily perform a swinging movement by the rotation of the support pin 203. The support pin 203 is linked to an electromagnetic clutch 301, which will be described below, so as to be able to receive the transmission of drive. Furthermore, at another end (the left end in FIGS. 2 and 3) of the pull-in arm 204, a pickup roller R1 is rotatably supported by a support pin 205 arranged in a direction orthogonal to the carry direction X. The pickup roller R1 and the separator roller R2 are driven linked via a drive transmission belt (not shown in drawings), and are configured so as to be driven/stopped by the electromagnetic clutch 301, which is capable of disconnecting a driving force from a drive motor, which will be described below, via the support pin 203.

Additionally, a support prop 206 is erected at the outer covering 11. At the support prop 206, an engaging piece 207 is supported by a support pin 207*c* so as to readily perform a swinging movement. By engaging an engaging claw 207*a* arranged at one end portion of the engaging piece 207 and an engaging claw 202*a* arranged at an upper end portion of the stopper member 202, the stopper member 202 is maintained in a substantially vertical state. In this way, the stopper member 202 bears the weight of the manuscripts G loaded in the manuscript tray 121 as described above, and in addition to aligning a carry-direction leading edge Ga of the manuscripts G, it also blocks the front (carry-direction upstream end) of the carry path 120 so that the manuscripts G do not inadvertently enter to the carry path 120.

On the other hand, a pressing pin 207*b* is provided as a protrusion in a horizontal direction at another end portion of the engaging piece 207, and the pressing pin 207*b* is pressed and driven by a pressing piece 204*b* provided at one end portion of the pull-in arm 204. Furthermore, on the engaging piece 207, the engaging claw 207*a* side is heavier than the pressing pin 207*b* side with respect to the support pin 207*c*. Accordingly, when the pressing piece 204*b* is not in contact with the pressing pin 207*b*, that is, when the pull-in arm 204 is in a raised state, the balance of the weight thereof causes the engaging claw 207*a* side to perform a swinging movement downward, and the engaging claw 207*a* engages with the engaging claw 202*a* of the stopper member 202.

Figure 4:
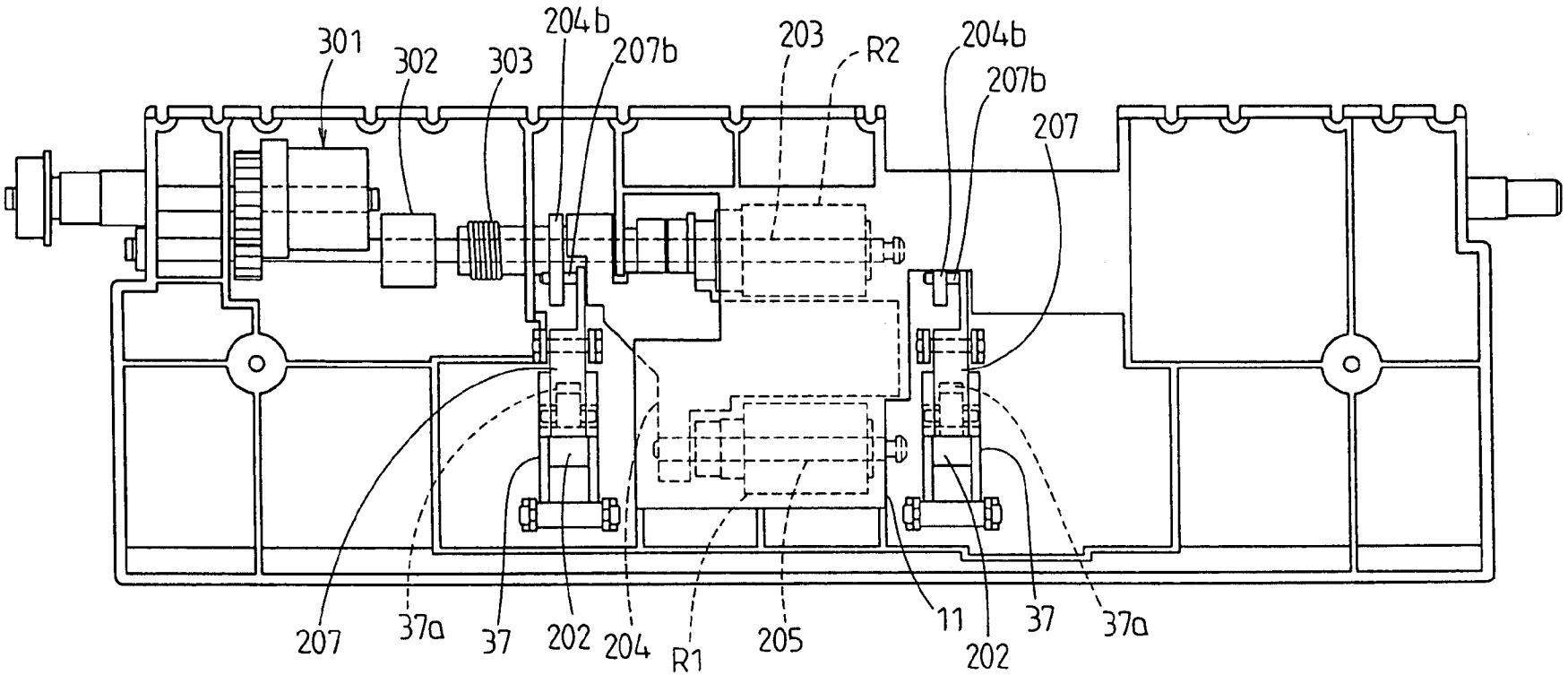
FIG. 4 is an overall bottom view as seen from below the manuscript carrying apparatus.

As shown in FIG. 4, the pull-in arm 204 that is provided with the pickup roller R1 and the separator roller R2 is arranged in an approximately central area widthwise of the outer covering 11 of the manuscript carrying apparatus 10, and the stopper members 202 and the engaging pieces 207 are respectively positioned on both outer sides widthwise of the pull-in arm 204. That is to say, the stopper members 202 and the engaging pieces 207 are arranged in pairs on both sides of the pull-in arm 204.

Figure 5:
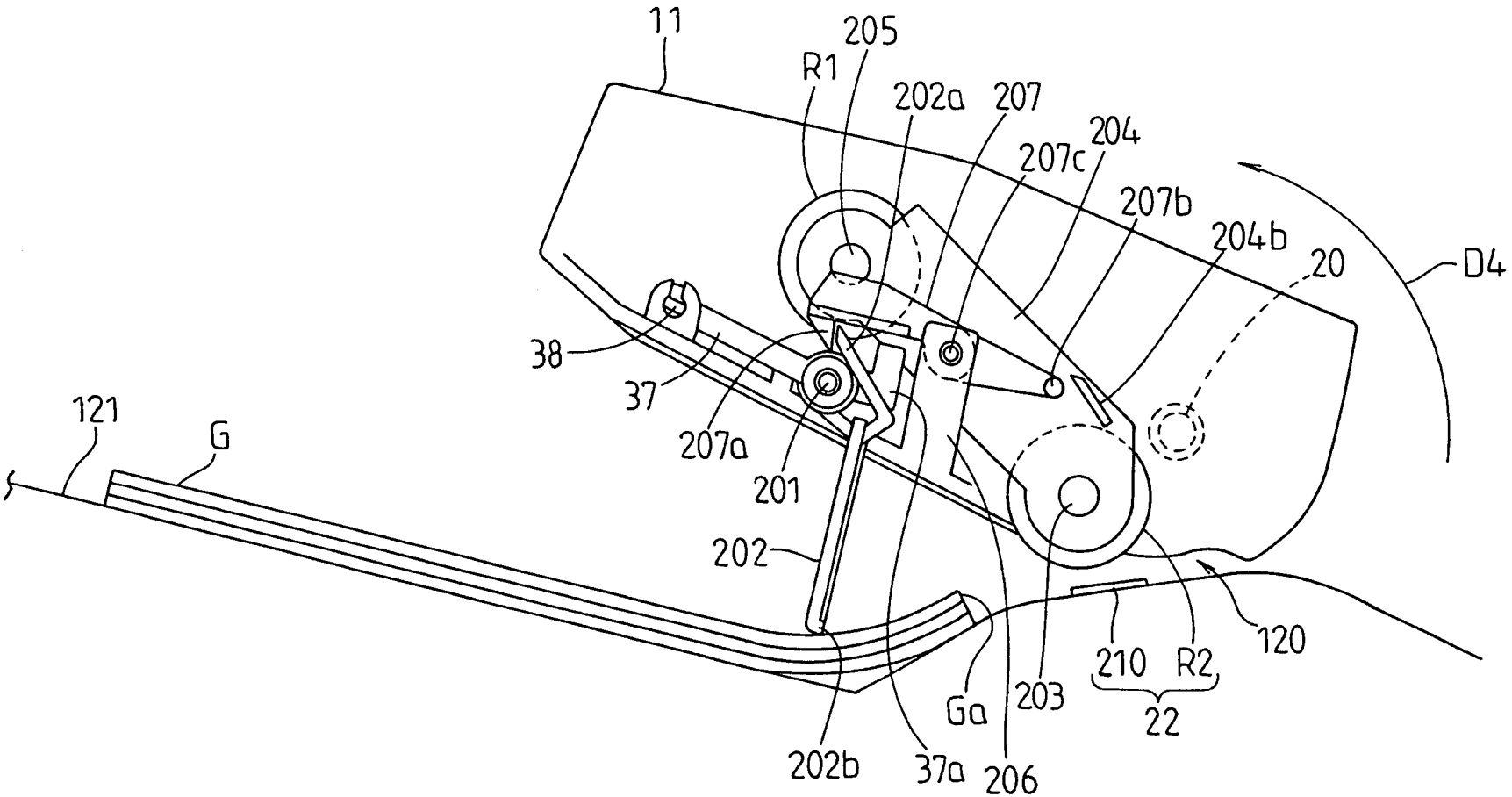
FIG. 5 is a longitudinal sectional view showing an overall configuration of the manuscript carrying apparatus.
Figure 6:
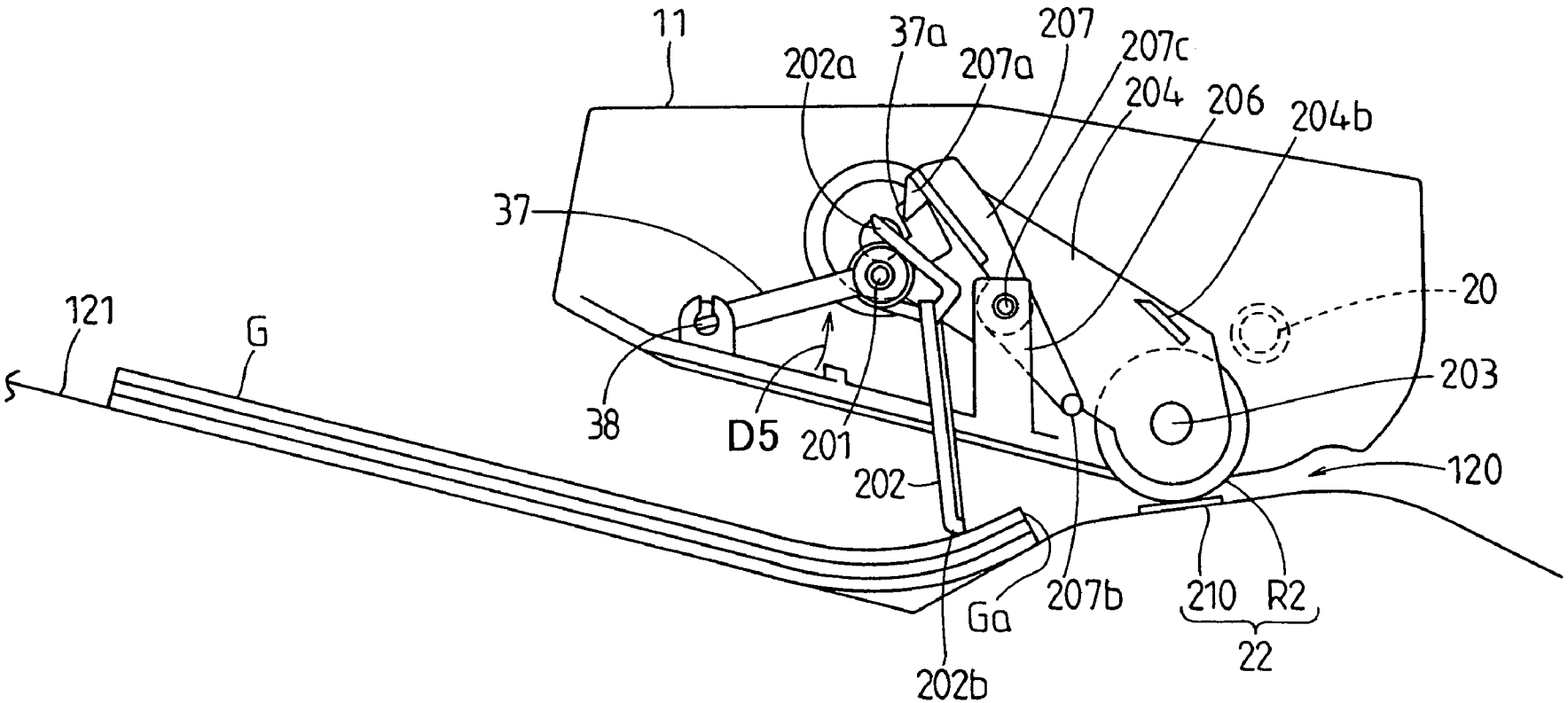
FIG. 6 is a longitudinal sectional view showing an overall configuration of the manuscript carrying apparatus.

Furthermore, as shown in FIGS. 5 and 6, the supporting axis 201 that supports the stopper members 202 such that they can readily perform a swinging movement is arranged so as to readily perform a swinging movement up and down. That is to say, one end portion of an arm member 37 is supported at the support axle 38, which is arranged in a direction orthogonal to the carry direction X of the manuscripts G in the bottom surface area of the outer covering 11 so as to readily perform a swinging movement, and the supporting axis 201 of the stopper members 202 is fixed to another end portion of the arm member 37. However, one end portion of the arm member 37 is supported so as to readily perform a swinging movement in the outer covering 11 at a position on an opposite side from the support prop 206 of the engaging pieces 207 with respect to the supporting axis 201 of the stopper members 202. Furthermore, another end portion of the arm member 37 is provided extending to a side of the support prop 206 farther than the supporting axis 201, and a lifting piece 37*a* is formed by bending upwards the extended end portion thereof in order to upwardly lift the engaging pieces 207. In this way, when a carry irregularity occurs, due to a drive control means that will be described below, the pull-in arm 204 performs a swinging movement upward from its position during the reading of the manuscripts exposed from below the outer covering 11, and the engagement of the pressing pin 207*b* of the engaging piece 207 and the pressing piece 204*b* of the pull-in arm 204 is released. When the outer covering 11 is opened in this state, as shown in FIG. 5, the manuscripts G slide down the manuscript tray 121 due to their own weight thus shifting from the manuscript loading position, the engaging piece 207 that was raised now performs a swinging movement downward by its own weight due to the release of the engagement, and the engaging claw 202*a* of the stopper member 202 that was raised along with the opening of the outer covering 11 and the engaging claw 207*a* of the engaging piece 207 become engaged. When the outer covering 11 is closed in the direction shown by the arrow D4 in FIG. 5, although a lower end portion 202*b* of the stopper member 202 comes in contact with the manuscripts G in the course of the closing process thereof, as shown in FIG. 6, the arm member 37 performs a swinging movement as shown by the arrow D5, and the stopper member 202 itself is lifted up along with the engaging piece 207. At this time, the stopper member 202 is positioned between the pivot points of the arm member 37 and the engaging piece 207, and the arm member 37 and the engaging piece 207 move away from each other when lifted up such that the engaged state of the engaging claw 207*a* and the engaging claw 202*a* is released. Furthermore, since the lifting piece 37*a* formed at the other end portion of the arm member 37 further presses upward on the engaging piece 207, the engaged state of the engaging claw 207*a* and the engaging claw 202*a* becomes reliably released.

In FIG. 4, a drive control means (not shown in drawings) for driving the pull-in arm 204 to perform a swinging movement is provided at one end of the pull-in arm 204, and the drive control means is mainly provided with a drive motor M (see FIG. 9) as a drive source, an electromagnetic clutch 301, a torque limiter 302 as driving force transmission member, and a pull-in arm spring 303 as a biasing force portion, such that the pickup roller R1 is raised and lowered via the pull-in arm 204 by the torque limiter 302 disconnectably connected to the drive motor via the electromagnetic clutch 301. That is to say, disconnection and connection of the driving force from the drive motor is carried out by the electromagnetic clutch 301, and the pickup roller R1 is raised and lowered in a vertical direction by the force of the torque limiter 302 causing the pull-in arm 204 to perform a swinging movement. Furthermore, the pull-in arm 204 constantly applies a biasing force to the pickup roller R1 by the pull-in arm spring 303 in an elevation direction, and when the force of the torque limiter 302 is not being exerted, the pickup roller R1 is raised to a predetermined position inside the outer covering 11 via the pull-in arm 204 by the biasing force of the pull-in arm spring 303.

Furthermore, as shown in FIG. 2, the engaging claw 202*a* of the stopper member 202 engages the engaging claw 207*a* of the engaging piece 207, and when reading of the manuscripts G commences while the front of the carry path 120 is blocked, the pull-in arm 204 is caused to swing as shown by the arrow D1 by the above-mentioned drive control means as shown in FIG. 3, and the pickup roller R1 contacts the upper surface of the manuscripts G such that the top manuscript is drawn out. Then, with the swinging movement of the pull-in arm 204, the pressing piece 204*b* presses down the pressing pin 207*b*, and the engaging claw 207*a* side of the engaging piece 207 lifts up as indicated by the arrow D2, and the engaged state between the engaging claw 207*a* and the engaging claw 202*a* is released. Consequently, when the drawing out of the top manuscript G proceeds, the stopper member 202 is lifted up as indicated by the arrow D3 at the carry-direction leading edge Ga of that manuscript G and the carry path 120 becomes open, such that only that single sheet of the manuscript G is picked up by the separator roller R2 and the separator plate 210 and guided to the manuscript reading portion 12. In this case, a separator portion 22 is constituted by the separator roller R2 and the separator plate 210.

Figure 7:
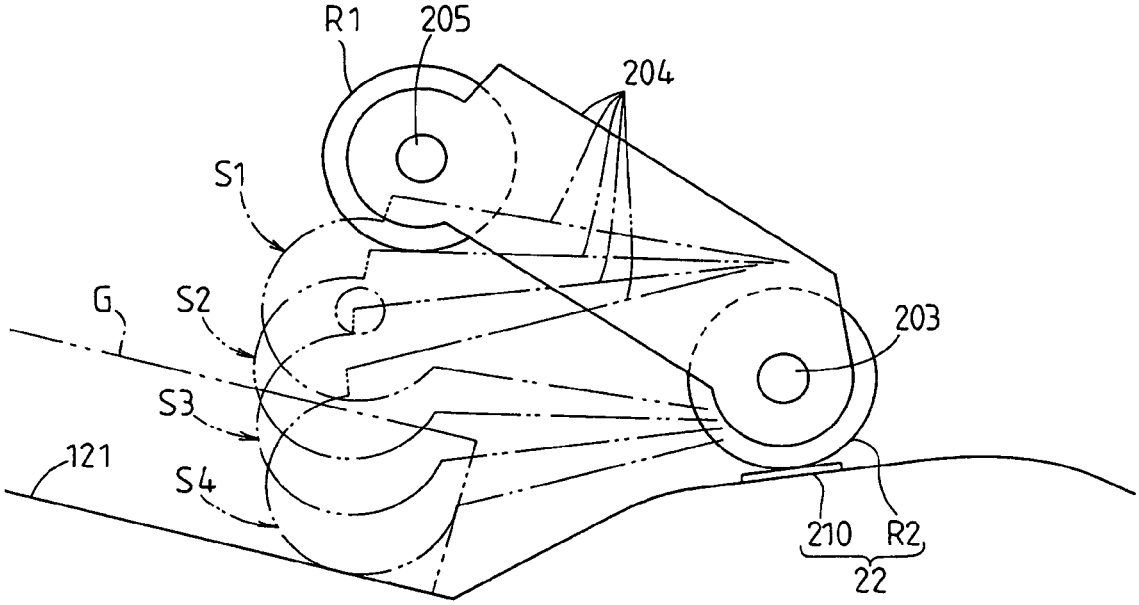
FIG. 7 is a longitudinal lateral view of the vicinity of a pull-in arm showing raising-lowering operations of a pickup roller.

In one aspect, the above-mentioned drive control means performs control as indicated in FIG. 7. Namely, when the electromagnetic clutch 301 is connected, while the pickup roller R1 is caused to rotate, the pull-in arm 204 is made to perform a swinging movement causing the pickup roller R1 to descend such that it approaches the upper surface of the manuscripts G in the manuscript tray 121. On the other hand, when the electromagnetic clutch 301 is disconnected, while the pickup roller R1 is caused to stop rotating, the pull-in arm 204 is caused to perform a swinging movement by the biasing force of the pull-in arm spring 303 that applies an upward biasing force that raises the pickup roller R1 such that it moves away from the upper surface of the manuscripts G in the manuscript tray 121 by an amount smaller than the descending amount. By carrying out such raising-lowering operations S1 to S4 four times and causing the pickup roller R1 to descend incrementally and gradually, the pickup roller R1 can be controlled such that it makes soft contact with the upper surface of the manuscripts G in the manuscript tray 121.

Figure 8:
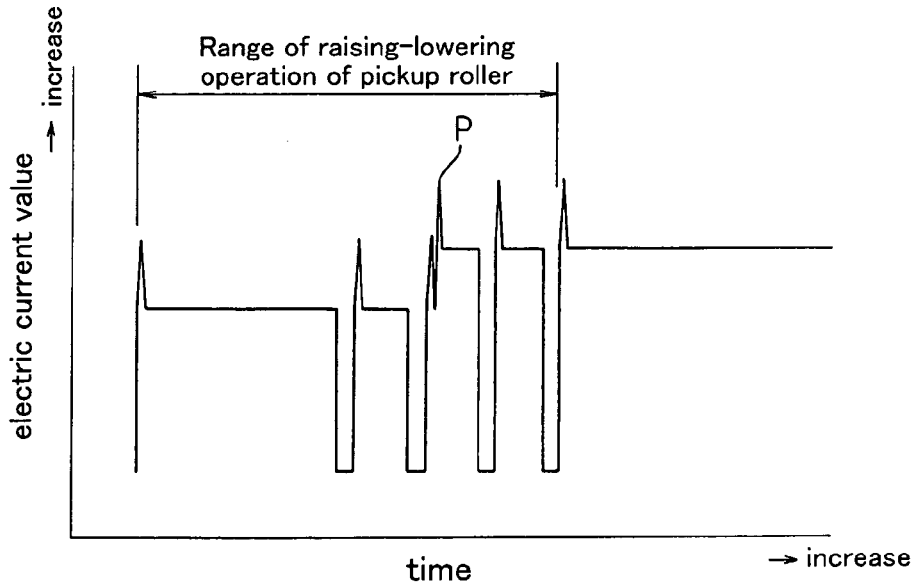
FIG. 8 is a characteristics drawing showing characteristics of a drive current with respect to time during raising-lowering operations of the pickup roller.

As shown in FIG. 8, the disconnection-connection commands given by the drive control means to the electromagnetic clutch 301 are carried out such that the electric current to the electromagnetic clutch 301 is switched ON/OFF four times. In carrying out these four incremental raising-lowering operations S1 to S4, the number of times is set in advance such that the driving electric current to the electromagnetic clutch 301 is switched ON/OFF so that the pickup roller R1 makes reliable contact with the upper surface of the manuscripts G in the manuscript tray 121. In this case, while the pickup roller R1 rotates when the electric current to the electromagnetic clutch 301 is ON, it stops rotating when this is OFF, and is caused to rotate intermittently by the electric current to the electromagnetic clutch 301 being switched ON/OFF four times.

Furthermore, as shown in FIG. 7, in the first raising-lowering operation S1 of the four incremental raising-lowering operations S1 to S4 of the pickup roller R1 based on the disconnection-connection commands to electromagnetic clutch 301 by the drive control means, the pickup roller R1 is lowered to a lowermost position of non-contact (the state in which 204 is in the position of S1 in FIG. 7) with the upper surface of the manuscripts G (the amount of manuscripts indicated by a dot-dot-dashed line in FIG. 7) when a maximum loadable amount (for example, 100 sheets) of the manuscripts G are loaded in the manuscript tray 121, and it is raised by the biasing force of the pull-in arm spring 303 away from the upper surface of the manuscripts G by an amount smaller than the amount it descended. Furthermore, as shown in FIG. 8, when the pickup roller R1 descends, that is, when the electric current to the electromagnetic clutch 301 is ON, a contact point P of the pickup roller R1 to the top manuscript G is detected based on a drive current load fluctuation when the pickup roller R1 makes contact with the top manuscript G. Regardless of which number of the raising-lowering operations of the pickup roller R1 it is at the time at which drive current load fluctuation is detected when the pickup roller R1 makes contact with the top manuscript G, the switching ON/OFF of the drive current to the electromagnetic clutch 301 by the drive control means is controlled such that the four incremental raising-lowering operations S1 to S4 of the pickup roller R1 are accomplished and such that the pickup roller R1 is made to rotate continuously to ensure that the top manuscript G is carried to the carry path 120 when the four incremental raising-lowering operations S1 to S4 of the pickup roller R1 are accomplished. Furthermore, the total carry distance of the top manuscript G carried intermittently by the rotation accompanying the lowering in the four raising-lowering operations S1 to S4 of the pickup roller R1 is set shorter than the manuscript carry distance from the carry-direction leading edge of the top manuscript G when the manuscripts G are loaded to the maximum loadable amount in the manuscript tray 121 until the separator portion 22 (the separator roller R2 and the separator plate 210). A reason for comparing the total carry distance of the top manuscript G carried intermittently by the rotation accompanying the descent of the four raising-lowering operations S1 to S4 of the pickup roller R1 to the manuscript carry distance from the carry-direction leading edge of the top manuscript G when the manuscripts G are loaded to the maximum loadable amount in the manuscript tray 121 until the separator portion 22 (the separator roller R2 and the separator plate 210) at this time is that the manuscript carry distance from the carry-direction leading edge of the top manuscript G when the manuscripts G are loaded to the maximum loadable amount in the manuscript tray 121 until the separator portion 22 is shorter than the manuscript carry distance from the carry-direction leading edge of the top manuscript G when the manuscripts G are loaded to the minimum loadable amount (for example, 1 sheet) in the manuscript tray 121 until the separator portion 22.

Figure 9:
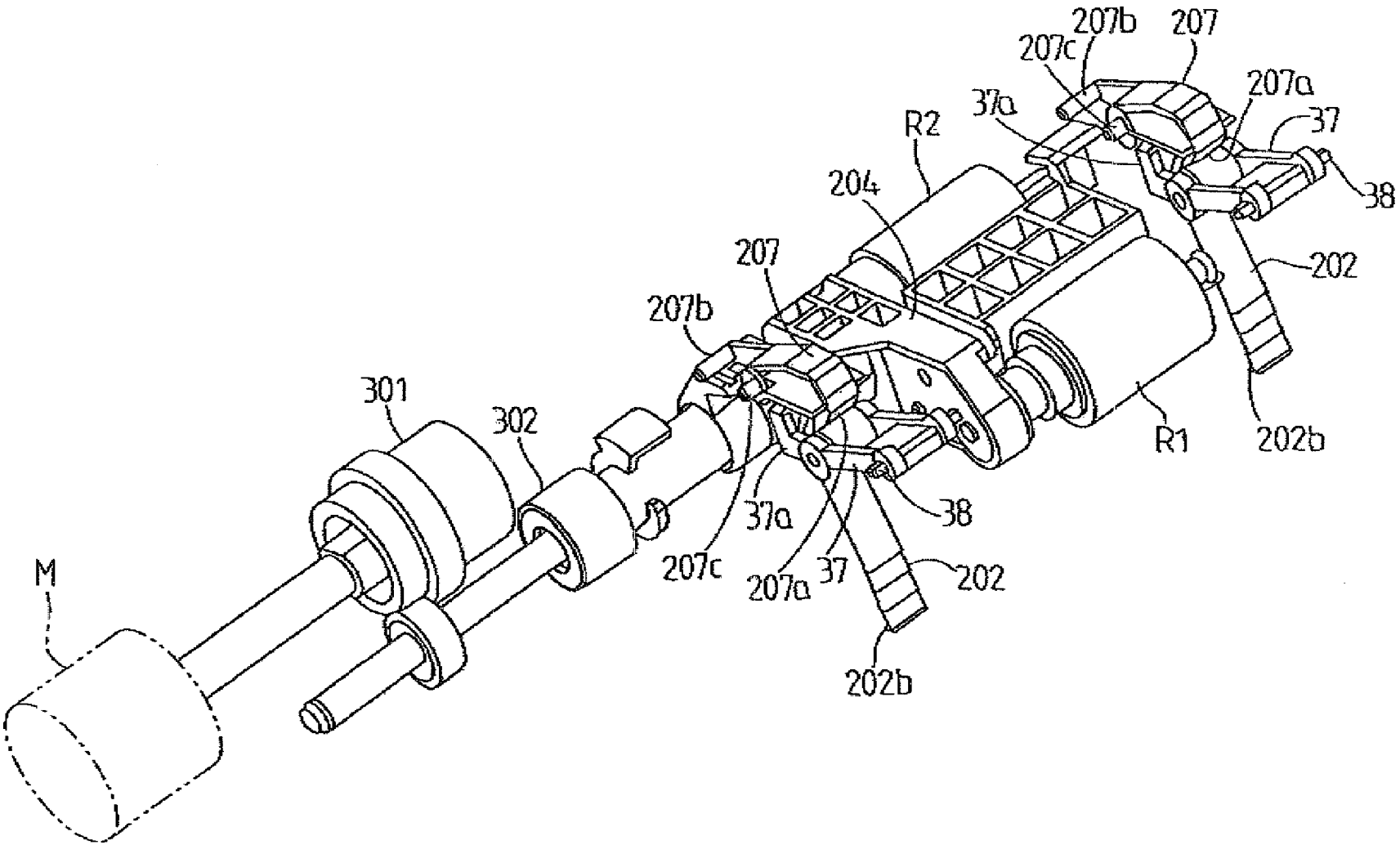
FIG. 9 is a perspective view showing an overall configuration of the manuscript carrying apparatus.
Figure 10:
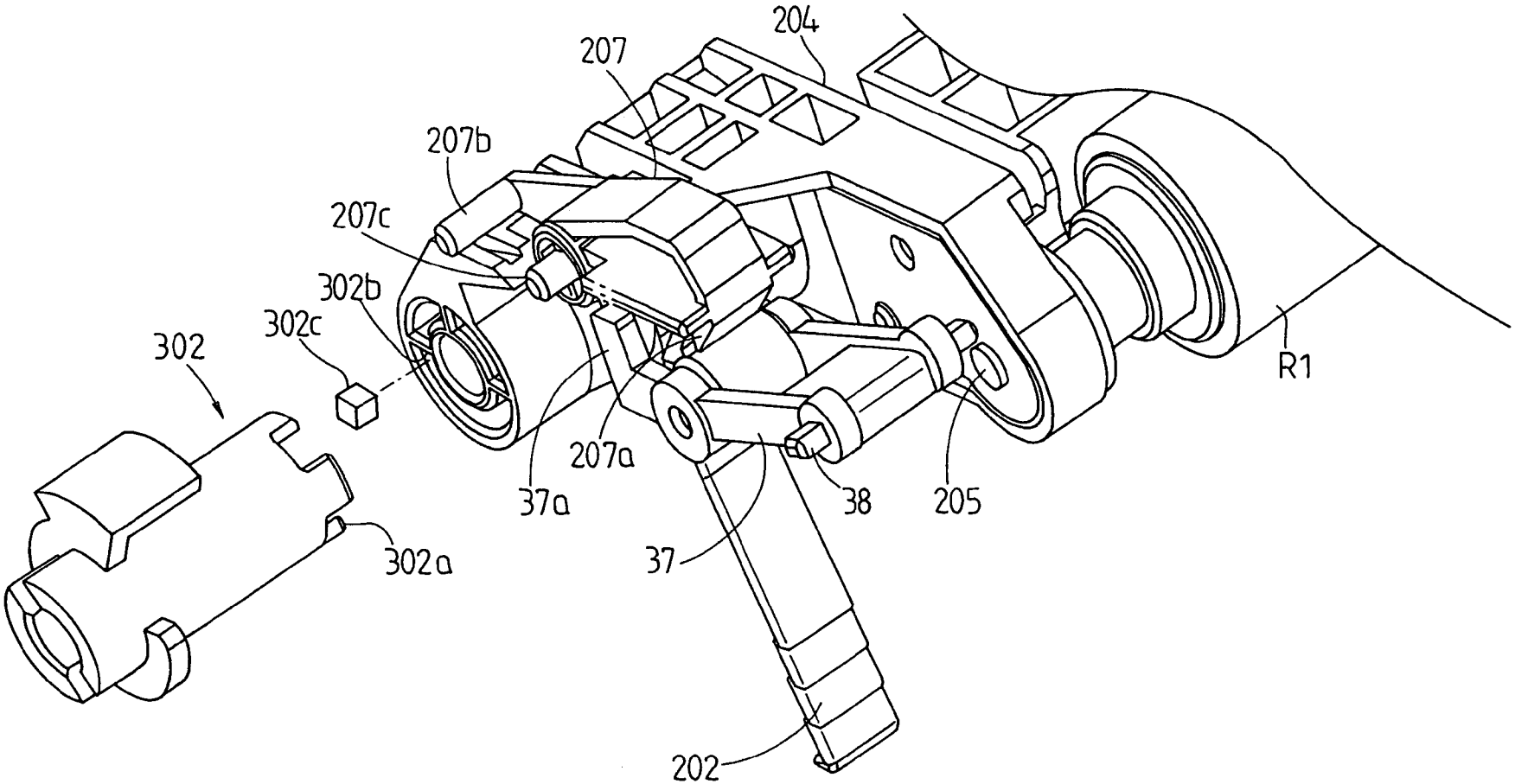
FIG. 10 is an overall perspective view of the manuscript carrying apparatus in a state in which a torque limiter is partitioned.
Figure 11:
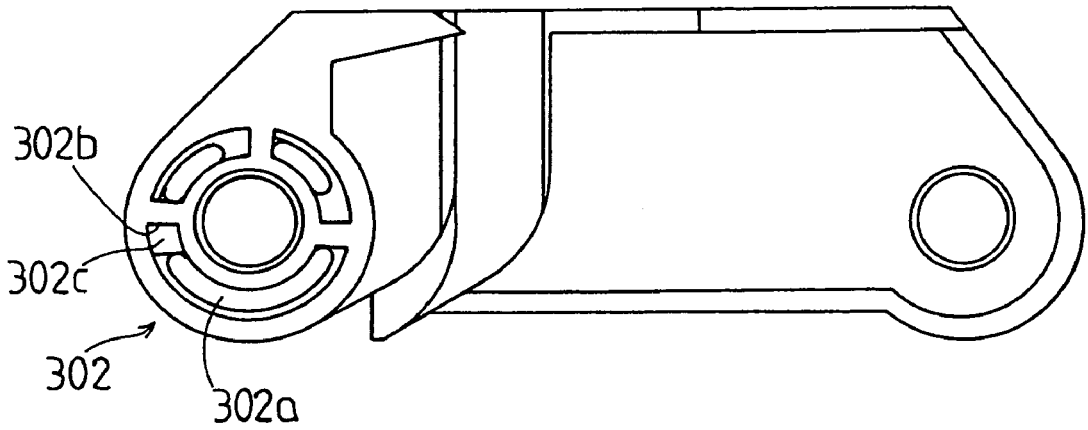
FIG. 11 is an overall lateral view of a pickup roller-side engaging portion of the torque limiter as seen from the electromagnetic clutch side.

Furthermore, as shown in FIGS. 9 and 10, the torque limiter 302 positioned between the electromagnetic clutch 301 and the pickup roller R1 is provided with an electromagnetic clutch-side engaging portion 302*a* partitioned with respect to the pickup roller R1 side and a pickup roller-side engaging portion 302*b* partitioned with respect to the electromagnetic clutch 301 side, and transmits driving force from the support pin 203 to the pickup roller R1 via the separator roller R2 and the drive transmission belt by the engaging of the mutually separate engaging portions 302*a* and 302*b* when the electromagnetic clutch 301 is connected. As shown in FIG. 11, an elastic member 302*c* made of rectangular rubber that elastically engages the electromagnetic clutch-side engaging portion 302*a* when the electromagnetic clutch 301 is connected is provided at the pickup roller-side engaging portion 302*b* of the torque limiter 302, and the drive current load fluctuation produced by the engaging action of the electromagnetic clutch-side engaging portion 302*a* and the pickup roller-side engaging portion 302*b* when the electromagnetic clutch 301 connects is suppressed. In this case, the elastic member 302*c* also has the function of applying a biasing force in a direction that causes the pickup roller R1 to rise when the electromagnetic clutch 301 connects.

Accordingly, the pickup roller R1 makes soft contact with the upper surface of the manuscripts G in the manuscript tray 121 by descending incrementally and gradually in the carrying out of the four raising-lowering operations S1 to S4 in which the pickup roller R1 is made to lowered by making the pull-in arm 204 to perform a swinging movement such that it approaches the upper surface of the manuscripts G in the manuscript tray 121 when the electromagnetic clutch 301 is connected, and the pickup roller R1 is made to rise by making the pull-in arm 204 to perform a swinging movement away from the upper surface of the manuscripts G in the manuscript tray 121 due to the biasing force of the pull-in arm spring 303 and the elastic member 302*c* by an amount smaller than the descent amount thereof. In this way, the pickup roller R1 always makes soft contact with the upper surface of the manuscripts G in the manuscript tray 121 even when there is a considerable difference in the distance the pickup roller R1 descends until making contact with the upper surface of the manuscripts G in the manuscript tray 121 between when a small amount of manuscripts G is loaded and when a large amount of manuscripts G is loaded. For this reason, even when for instance there are few manuscripts loaded in the manuscript tray 121, the impact sound (contact sound) produced by the contact with the upper surface can be made as small as possible.

In addition to this, drive current load fluctuation that occurs when the electromagnetic clutch 301 connects is suppressed by the elastic member 302*c* between the electromagnetic clutch-side engaging portion 302*a* and the pickup roller-side engaging portion 302*b* of the torque limiter 302. For this reason, in case a plurality of manuscripts G are carried intermittently by the rotation of the pickup roller R1 contacting the upper surfaces of the manuscripts G, the impact caused by the engagement action of the electromagnetic clutch-side engaging portion 302*a* and the pickup roller-side engaging portion 302*b* of the torque limiter 302 when an engagement action of the electromagnetic clutch 301 is carried out between manuscripts G is eased by the elastic member 302*c*, and does not almost become a cause of drive current load fluctuation when the electromagnetic clutch connects. In this way, there is almost no slight lag in the carry velocity of the manuscripts G being carried to the manuscript reading portion 12, and blurring in the reading of the manuscript G caused by drive current load fluctuation in the manuscript reading portion 12 can be reliably prevented.

In the first raising-lowering operation S1 of the four incremental raising-lowering operations S1 to S4 of the pickup roller R1, the pickup roller R1 is lowered to a lowermost position of non-contact (the state in which 204 is in the position of S1 in FIG. 7) with the upper surface of the manuscripts G (the amount of manuscripts indicated by a dot-dot-dashed line in FIG. 7) when the maximum loadable amount of the manuscripts G are loaded in the manuscript tray 121, and it is raised by the biasing force of the pull-in arm spring 303 away from the upper surface of the manuscripts G by an amount smaller than the amount it descended. In this way, the pickup roller R1 does not make contact with the upper surface of the manuscripts G in the first raising-lowering operation S1 even when the maximum loadable amount of the manuscripts G are loaded in the manuscript tray 121, and it is possible to efficiently and rapidly bring about contact of the pickup roller R1 to the upper surface of the manuscripts G by carrying out a plurality of raising-lowering operations with the first lowering amount of the pickup roller R1 being made as large as possible.

Furthermore, regardless of which number of the raising-lowering operations of the pickup roller R1 it is at the time at which drive current load fluctuation is detected when the pickup roller R1 makes contact with the top manuscript G, the pickup roller R1 is controlled such that the four incremental raising-lowering operations S1 to S4 of the pickup roller R1 are accomplished and such that the pickup roller R1 is made to rotate continuously to ensure that the top manuscript G is carried to the carry path 120 when the four incremental raising-lowering operations S1 to S4 of the pickup roller R1 are accomplished, and therefore the pickup roller R1 can be caused to reliably make contact with the top manuscript G when the four incremental raising-lowering operations S1 to S4 are accomplished. In addition to this, even if the pickup roller R1 makes contact with the top manuscript G before accomplishing the four raising-lowering operations S1 to S4, the top manuscript G is intermittently carried to the carry path 120 by the rotation accompanying the lowering of the pickup roller R1 such that the driving force of the pickup roller R1 can be transmitted almost without waste to the top manuscript G.

The total carry distance of the top manuscript G carried intermittently by the rotation accompanying the lowering in the four raising-lowering operations S1 to S4 of the pickup roller R1 is set be shorter than the manuscript carry distance from the carry-direction leading edge of the top manuscript G when the manuscripts G are loaded to the maximum loadable amount in the manuscript tray 121 until the separator portion 22 (the separator roller R2 and the separator plate 210). In this way, when the pickup roller R1 makes contact with the top manuscript G before accomplishing the four raising-lowering operations S1 to S4, even if the top manuscript G is intermittently carried to the carry path 120 by the rotation accompanying the lowering of the pickup roller R1, the carry-direction leading edge Ga of the top manuscript G does not reach the separator portion 22. For this reason, even when the top manuscript G and the manuscript G under it are inadvertently carried together when the top manuscript G is intermittently carried by the rotation accompanying the lowering of the pickup roller R1, the carry-direction leading edges Ga of a plurality of manuscripts G do not reach the separator portion 22. The plurality of manuscripts G carried by the continuous rotation of the pickup roller R1 after the accomplishment of the four raising-lowering operations S1 to S4 are reliably separated by the separator portion 22 and it is possible to reliably prevent double-feeding of a plurality of manuscripts G to the carry-direction downstream side from the separator portion 22.

Further still, by using the above-described manuscript carrying apparatus 10 in the automatic manuscript reading apparatus 1, it is possible to provide the automatic manuscript reading apparatus 1 that is capable of reducing the impact sound (contact sound) as much as possible when the pickup roller R1 is brought in contact with the upper surface of the manuscripts G regardless of the amount of manuscripts G loaded in the manuscript tray 121 and capable of easing the impact at the time of an engagement action between the clutch-side engaging portion and the pickup roller-side engaging portion such that blurring of the reading of the manuscripts G due to drive current load fluctuation in the manuscript reading portion 12 is reliably prevented.

Figure 12:
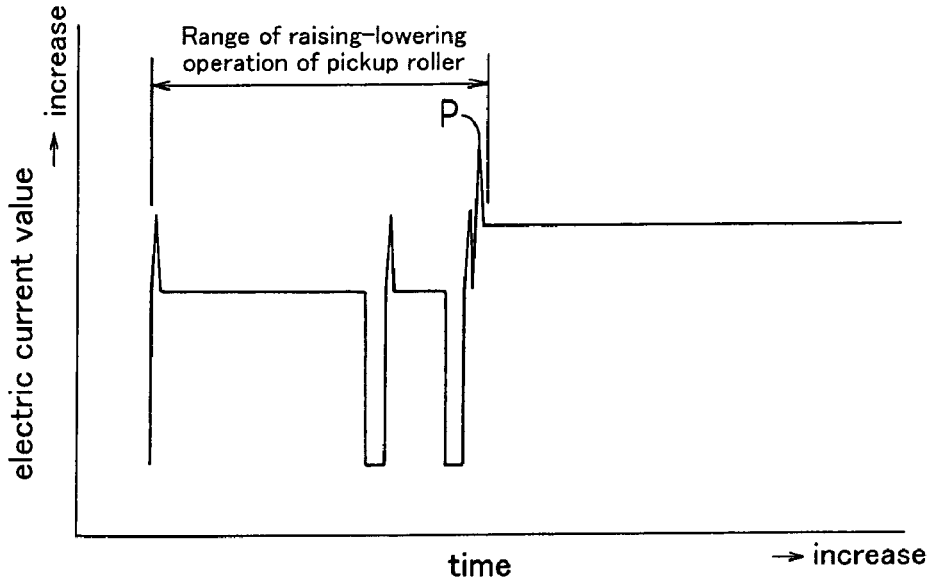
FIG. 12 is a characteristics drawing showing characteristics of a drive current with respect to time during raising-lowering operations of a pickup roller associated with a modified example.

It should be noted that, in the present embodiment, although the pickup roller R1 was controlled so that it rotated continuously after accomplishing the four incremental raising-lowering operations S1 to S4 of the pickup roller R1 regardless of which number raising-lowering operation of the pickup roller R1 it was when the pickup roller R1 made contact with the top manuscript G, it is also possible that, as shown in FIG. 12, when the point P of contact of the pickup roller R1 to the top manuscript G is detected based on a drive current load fluctuation when the pickup roller R1 contacts the top manuscript G before accomplishing four raising-lowering operations (three times in FIG. 12), the pickup roller is controlled such that any subsequent raising-lowering operation (fourth raising-lowering operation) is stopped based on that drive current load fluctuation and the pickup roller rotates to carry the top manuscript G to the carry path. In this case, the top manuscript G is swiftly carried to the carry path 120 and reading of the manuscript G can be carried out speedily.

Furthermore, in the present embodiment, the pickup roller R1 was raised by causing the pull-in arm 204 to perform a swinging movement such that the pickup roller moved away from the upper surface of the manuscripts G in the manuscript tray 121 by the biasing force of the pull-in arm spring 303 and the elastic member 302*c* when the electromagnetic clutch 301 was disconnected, but it is also possible to raise the pickup roller with only the biasing force of the elastic member by causing the pull-in arm to perform a swinging movement away from the upper surface of the manuscripts in the manuscript tray without providing a pull-in arm spring. In this case, the elastic member has both the function of easing the impact of the engagement action of the electromagnetic clutch-side engaging portion 302*a* and the pickup roller-side engaging portion 302*b* of the torque limiter 302, and the function of causing the pickup roller to rise, which makes it possible to reduce the number of components by making a component have a double purpose.

Figure 13:
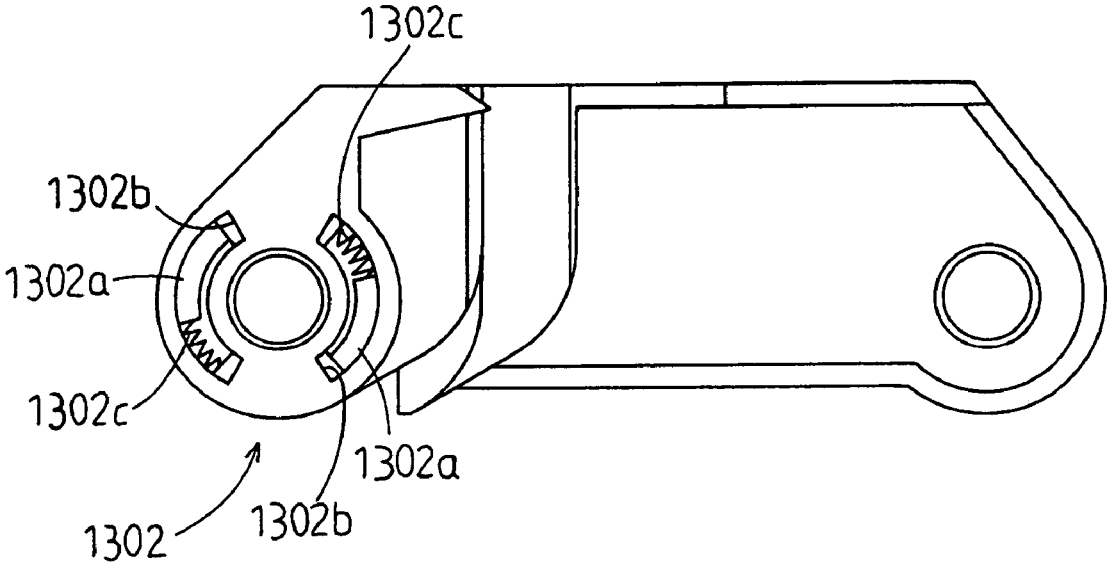
FIG. 13 is an overall lateral view of a pickup roller-side engaging portion of the torque limiter associated with a modified example as seen from the electromagnetic clutch side.

Furthermore, as shown in FIG. 13, it is also possible to provide, between a pickup roller-side engaging portion 1302*b* and an electromagnetic clutch-side engaging portion 1302*a* of a torque limiter 1302, a spring 1302*c* acting as an elastic member that elastically engages the pickup roller-side engaging portion 1302*b* and the electromagnetic clutch-side engaging portion 1302*a* when the electromagnetic clutch 301 is connected. In this case too it is possible to suppress the drive current load fluctuation produced by the engagement action of the electromagnetic clutch-side engaging portion 1302*a* and the pickup roller-side engaging portion 1302*b* when the electromagnetic clutch 301 connects, as well as to raise the pickup roller R1 by causing the pull-in arm 204 to perform a swinging movement away form the upper surface of the manuscripts G in the manuscript tray 121 due to the biasing force of the spring 1302*c* when the electromagnetic clutch 301 disconnects.

Also, in the above embodiment, the total carry distance of the top manuscript G carried intermittently by the rotation accompanying the lowering in the four raising-lowering operations S1 to S4 of the pickup roller R1 was set shorter than the manuscript carry distance from the carry-direction leading edge of the top manuscript G when the manuscripts G were loaded to the maximum loadable amount until the separator portion 22, but it is also possible to set the total carry distance of the top manuscript G carried intermittently by the rotation accompanying the lowering in the four raising-lowering operations S1 to S4 of the pickup roller R1 to a manuscript carry distance in which at least the carry-direction leading edge does not reach a manuscript input sensor. In this case, manuscripts carried intermittently by the rotation accompanying the lowering of the pickup roller are not detected by the manuscript insertion sensor when the four raising-lowering operations are accomplished and, it is possible to prevent adverse effects to the paired drive roller R3 and following roller R4 (PS rollers), which set the timing for manuscript reading based on a detected detection signal from the manuscript insertion sensor, and carry out manuscript reading smoothly without causing a delay.

Further still, in the above embodiment, the pickup roller R1 was lowered in the incremental raising-lowering operations S1 to S4 so as to make soft contact with the top manuscript by switching the electric current to the electromagnetic clutch 301 ON/OFF four times, but of course it is also possible to have the pickup roller make soft contact with the top manuscript G by lowering the pickup roller in five or more incremental raising-lowering operations.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A manuscript carrying apparatus, comprising:

a pickup roller arranged to rotate while being lowered from above manuscripts such that the pickup roller automatically takes out sheet-by-sheet and carries to a carry path one or more manuscripts loaded in the manuscript tray through contact with the sheets of the manuscript;

a drive source disconnectably connected to the pickup roller via a clutch and is configured to raise and lower the pickup roller when the clutch disconnects and connects, respectively;

a biasing force portion arranged to provide an upward biasing force to the pickup roller when the clutch disconnects from the drive source to raise the pickup roller, wherein the pickup roller makes a soft contact to an upper surface of a top manuscript in the manuscript tray by being lowered incrementally and gradually in a plurality of repetitions of a raising-lowering operation to approach the upper surface of the top manuscript in the manuscript tray in which the pickup roller rotates while being lowered and stops rotating while being raised and in which an amount of raising of the pickup roller is smaller than a previous raising amount;

at least one driving force transmission member provided between the clutch and the pickup roller and arranged to transmit a driving force to the pickup roller by an engagement of mutually partitioned engaging portions when the clutch connects; and at least one elastic member provided between the clutch-side engaging portion partitioned in the pickup roller and the pickup roller-side engaging portion partitioned in the clutch side of the driving force transmission member and arranged to suppress drive power load fluctuation produced by disconnection/connection of the clutch.

2. The manuscript carrying apparatus according to claim 1, wherein a first raising-lowering operation of the plurality of incremental raising-lowering operations of the pickup roller is carried out such that the pickup roller is lowered to approach a lowermost position of non-contact to the upper surface of the top manuscript when a maximum loadable amount of manuscripts is loaded in the manuscript tray and is raised away from the upper surface of the top manuscript by an amount less than that lowering amount.

3. An automatic manuscript reading apparatus that uses a manuscript carrying apparatus according to claim 2.

4. The manuscript carrying apparatus according to claim 1, wherein the plurality of incremental raising-lowering operations of the pickup roller is preset to a predetermined number of times such that the pickup roller makes contact with the upper surface of the top manuscript in the manuscript tray, and the pickup roller is configured to continuously rotate once the predetermined number of times of the raising-lowering operations have been accomplished so as to carry the top manuscript to the carry path.

5. The manuscript carrying apparatus according to claim 4, comprising a separator portion further downstream from the pickup roller in the carry path, the separator portion separating only the top manuscript from a plurality of manuscripts inadvertently carried by the pickup roller, wherein a total carry distance of the top manuscript carried intermittently by rotation accompanying lowering in the predetermined number of times of raising-lowering operations of the pickup roller is set shorter than a manuscript carry distance from a carry-direction leading edge of the top manuscript when the manuscripts are loaded to the maximum loadable amount in the manuscript tray until the separator portion.

6. The manuscript carrying apparatus according to claim 4, comprising at least one leading-trailing edge detection sensor at a mid-position of the carry path that detects a carry-direction leading/trailing edge of the manuscript, wherein the total carry distance of the top manuscript carried intermittently by rotation accompanying lowering in the predetermined number of times of raising-lowering operations of the pickup roller is set to a manuscript carry distance in which at least the carry-direction leading edge does not reach the leading-trailing edge detection sensor.

7. An automatic manuscript reading apparatus that uses a manuscript carrying apparatus according to claim 4.

8. An automatic manuscript reading apparatus that uses a manuscript carrying apparatus according to claim 1.

9. The manuscript carrying apparatus according to claim 1, wherein the plurality of incremental raising-lowering operations of the pickup roller is preset to a predetermined number of times such that the pickup roller makes contact with the upper surface of the top manuscript in the manuscript tray, wherein contact of the pickup roller to the upper surface of the top manuscript in the manuscript tray is detected based on drive power load fluctuation produced when the pickup roller makes contact with the upper surface of the top manuscript, and the pickup roller is configured such that, based on drive power load fluctuation detected when contact is made with the upper surface of the top manuscript in the manuscript tray before the predetermined number of times of raising-lowering operations are accomplished, sub sequent raising-lowering operations are stopped and the pickup roller continuously rotates so as to carry the top manuscript to the carry path.

10. An automatic manuscript reading apparatus that uses a manuscript carrying apparatus according to claim 9.

11. A manuscript carrying apparatus, comprising:

a pickup roller arranged to rotate while being lowered from above manuscripts such that the pickup roller automatically takes out sheet-by-sheet and carries to a carry path one or more manuscripts loaded in the manuscript tray through contact with the sheets of the manuscript;

a drive source disconnectably connected to the pickup roller via a clutch and configured to raise and lower the pickup roller when the clutch disconnects and connects respectively, wherein the pick up roller makes a soft contact to an upper surface of a top manuscript in the manuscript tray by being lowered incrementally and gradually in a plurality of repetitions of a raising-lowering operation to approach the upper surface of the top manuscript in the manuscript tray in which the pickup roller rotates while being lowered and stops rotating while being raised and in which an amount of raising of the pickup roller is smaller than a previous raising amount;

at least one driving force transmission member provided between the clutch and the pickup roller and arranged to transmit a driving force to the pickup roller by an engagement of mutually partitioned engaging portions when the clutch connects; and at least one elastic member provided between the clutch-side engaging portion partitioned in the pickup roller and the pickup roller-side engaging portion partitioned in the clutch side of the driving force transmission member and arranged to suppress drive power load fluctuation produced by disconnection/connection of the clutch and applies a biasing force in a direction causing the pickup roller to rise when the clutch disconnects is.

* * * * *